US009206781B2

(12) United States Patent
Qin et al.

(10) Patent No.: US 9,206,781 B2
(45) Date of Patent: Dec. 8, 2015

(54) AUXILIARY MESH TYPE STARTER

(71) Applicant: PRESTOLITE ELECTRIC (BEIJING) LIMITED, Tongzhou District (CN)

(72) Inventors: Sunshine Qin, Tongzhou District (CN); Robin Hu, Tongzhou District (CN); Big Li, Tongzhou District (CN)

(73) Assignee: PRESTOLITE ELECTRIC (BEIJING) LIMITED, Beijing (CN)

( * ) Notice: Subject to any disclaimer, the term of this patent is extended or adjusted under 35 U.S.C. 154(b) by 0 days.

(21) Appl. No.: 14/378,275

(22) PCT Filed: Jun. 25, 2013

(86) PCT No.: PCT/CN2013/077891

§ 371 (c)(1),
(2) Date: Aug. 12, 2014

(87) PCT Pub. No.: WO2014/000625

PCT Pub. Date: Jan. 3, 2014

(65) Prior Publication Data

US 2015/0097375 A1 Apr. 9, 2015

(30) Foreign Application Priority Data

Jun. 25, 2012 (CN) ..... 2012 1 0213899

(51) Int. Cl.

| | |
|---|---|
| ***F02N 11/08*** | (2006.01) |
| ***F02N 15/06*** | (2006.01) |
| ***F02N 11/02*** | (2006.01) |

(Continued)

(52) U.S. Cl.

CPC ..... *F02N 11/0851* (2013.01); *F02N 11/02* (2013.01); *F02N 11/087* (2013.01); *F02N 15/067* (2013.01); *H01H 47/22* (2013.01); *H01H 51/065* (2013.01)

(58) Field of Classification Search

CPC ..... F02N 11/08
USPC ..... 290/38 R
See application file for complete search history.

(56) References Cited

U.S. PATENT DOCUMENTS

| | | | | |
|---|---|---|---|---|
| 2,242,772 | A * | 5/1941 | Bales | 290/38 R |
| 7,973,623 | B2 * | 7/2011 | Andoh | 335/126 |

(Continued)

FOREIGN PATENT DOCUMENTS

| | | | |
|---|---|---|---|
| CN | 2606808 | Y | 3/2004 |
| CN | 202058651 | U | 11/2011 |

(Continued)

*Primary Examiner* — Joseph Waks
(74) *Attorney, Agent, or Firm* — Ming Chow; Sinorica, LLC

(57) ABSTRACT

An auxiliary mesh type starter, including a motor, an electromagnetic switch connected with the motor and relays connected with the electromagnetic switch, wherein the electromagnetic switch includes a holding coil, an attracting coil, a stop seat arranged at the rear end parts of the holding coil and the attracting coil, a plunger arranged on the inner circumferences of the holding coil and the attracting coil and capable of sliding in an axial direction, a return spring for applying return force to the plunger, and a contact point arranged at the rear end of the plunger; and the relays are connected to a key switch, wherein the relays include a first relay and a second relay, with the head end of the attracting coil connects to the key switch via the first relay, and the head end of the holding coil connects to the key switch via the second relay.

16 Claims, 6 Drawing Sheets

(51) Int. Cl.
*H01H 47/22* (2006.01)
*H01H 51/06* (2006.01)

(56) References Cited

U.S. PATENT DOCUMENTS 8,492,916 B2 * 7/2013 Murata et al. ..... 290/38 R
2009/0206965 A1 * 8/2009 Niimi ..... 335/106

FOREIGN PATENT DOCUMENTS

CN 102472233 A 5/2012
CN 102472235 A 5/2012
DE 102009000125 A1 7/2010
DE 102009028292 A1 * 2/2011

* cited by examiner

AUXILIARY MESH TYPE STARTER

TECHNICAL FIELD

The present invention relates to a starter, and more particularly to an auxiliary mesh type starter.

BACKGROUND ART

FIG. 1 is a cross-sectional view of the currently existing auxiliary mesh type starter. As shown in FIG. 1, the auxiliary mesh type starter which applies a starting torque to an engine has the following structure: a speed reducer 2 is adapted to decelerate the rotational torque of an armature 11 in a motor 1 and to increase rotational torques, and an isolator 4 is mounted on a driving gear 6 of an output shaft 5 and is driven by the motor 1 to rotate.

Referring to FIG. 2, an auxiliary mesh type starter comprises a motor 1, an electromagnetic switch 3 and relays 12. In the auxiliary mesh type starter, the electromagnetic switch 3 comprises an attracting coil 36, a holding coil 37 (the holding coil 37 and the attracting coil 36 are arranged on a coil frame 43), an solenoid body 7 circumferentially surrounds the outer sides of the attracting coil 36 and the holding coil 37 and constitutes a portion of a magnetic circuit, a stop seat 16 is arranged at the rear end parts of the attracting coil 36 and the holding coil 37 and constitutes a portion of the magnetic circuit, a plunger 8 is arranged on the inner circumferences of the attracting coil 36 and the holding coil 37 and is capable of sliding in an axial direction, a return spring 14 applies a return force to the plunger 8, and a movable contact point 17 is mounted at the rear end of the plunger 8, and a pair of stationary contact points 30*a* and 30*b* are arranged relative to the movable contact point 17 and are connected to the external wiring. An electromagnetic attraction force in the B-direction as shown in FIG. 1 is generated in the plunger 8 by energizing the attracting coil 36 and the holding coil 37 of the electromagnetic switch 3. Owing to the electromagnetic attraction force, the upper end of a shift fork 9 in cooperation with the plunger 8 moves towards the right direction (indicated by arrow B) and the lower end thereof moves towards the left direction (indicated by arrow A) as shown in FIG. 1. Thus, a force is applied to the isolator 4 and the driving gear 6 on the output shaft 5 to cause them to move towards the left direction (indicated by arrow A) as shown in FIG. 1, then the driving gear 6 moves towards such a direction that it is going to mesh with a flywheel gear ring 10 of the engine.

Also referring to FIG. 2, the positive terminal of a storage battery 13 is connected to a terminal 18 of the electromagnetic switch 3, and the negative terminal is grounded or connected to a terminal 31 of the motor 1. The relay 12 which switches on/off a terminal 50 of the electromagnetic switch 3 includes: a terminal 50*c* connected to the storage battery 13, a contact point 32 connected to the terminal 18, and a coil 34 for controlling the contact point 32 and a contact point 33. The terminal 50*c* located at one end of the coil 34 is connected via a key switch 35 to the positive terminal of the storage battery 13. The other end of the coil 34 is grounded or connected to the negative terminal 31.

In FIG. 2, if the key switch 35 is closed to start the engine, then the coil 34 of the relay 12 is energized to form a closed circuit between the contact point 32 and the contact point 33, and the storage battery 13 energizes the motor 1 via the attracting coil 36 of the electromagnetic switch 3 while energizing the holding coil 37. The two energized coils generate an attraction force in the plunger 8, so that the plunger 8 compresses the return spring 14 while moving in the B-direction, and the driving gear 6 moves towards one side of the flywheel gear ring 10 via the shift fork 9 (i.e., in the A-direction).

At this time, if the driving gear 6 smoothly meshes with the flywheel gear ring 10, then the plunger 8 further moves until it contacts the end face of an arresting disc 16, the movable contact point 17 comes into contact with the two stationary contact points 30*a* and 30*b*, the motor 1 is directly energized by the storage battery 13 to generate a usual rotational torque, and the driving gear 6 drives the flywheel gear ring 10 to rotate, thereby applying a starting torque to the engine. When the movable and stationary contact points are in contact with each other, the potentials of the terminal 50 and the terminal 19 are substantially the same, so no electric current flows through the attracting coil 36, and the plunger 8 is kept in the position where it contacts the end face of the arresting disc 16 only with the holding force generated by the holding coil 37.

After starting, if the key switch 35 is disconnected, then the coil 34 is not energized, a circuit break occurs between the contact point 32 and the contact point 33, and no voltage is applied to the terminal 50. So, the holding force generated by the holding coil 37 disappears, the plunger 8 returns to the state as shown in FIG. 1 with the aid of the spring force generated by the return spring 14, and, partly with the aid of the shift fork 9 cooperating with the plunger 8, the driving gear 6 breaks away from the flywheel gear ring 10. Meanwhile, the movable contact point 17 also returns to the state as shown in FIG. 1, thereby stopping energizing the motor.

As can be seen from FIG. 2, the coil of the electromagnetic switch 3 consists of the attracting coil 36 and the holding coil 37. The numbers of turns of the two coils are substantially equal, their head ends are connected together, and the tail end of the attracting coil 36 is connected to the power supply terminal (also the output terminal of the main contact point of the electromagnetic switch 3) of a DC motor, and the tail end of the holding coil 37 is kept grounded.

In addition, the attracting coil 36 of the electromagnetic switch 3 has low resistance, which is typically about 100 milliohms or so. In this way, the starter can turn slowly at a low torque before the closure of the main contact point of the electromagnetic switch 3, so that when the driving gear 6 is pushed against the end face of the flywheel gear ring 10, it can rotate slowly so that it is not pushed against the gear and then meshes with the flywheel gear ring 10; only after it meshes with the flywheel gear ring 10, will the main contact point of the electromagnetic switch 3 be closed (i.e., will the movable contact point 17 come into contact with the two stationary contact points 30*a* and 30*b*), will a large current flow through the motor 1, and will a high torque be output from the starter, thereby avoiding a gear milling failure in the starter. Therefore, such starters are also called flexible mesh starters.

Such conventional auxiliary mesh type starters have the following problems:

(1) Since the head end of the attracting coil and the head end of the holding coil of the electromagnetic switch in this type of starter are connected together, in order to guarantee the reliable power off of the electromagnetic switch, the attracting coil and the holding coil of the electromagnetic switch must have substantially the same effective number of turns and, in the meanwhile, the holding coil must not have too few turns. This means that the attracting coil must also have quite a few turns. Although the starter can be enabled to rotate slowly before the closure of the main contact point of the electromagnetic switch by a method which comprises appropriately increasing the coil diameter of the attracting coil and reducing the number of turns of the attracting coil, the number of turns of the attracting coil cannot be reduced sharply, otherwise the number of turns of the holding coil has to be reduced drastically with an eye to the reliable power off of the electromagnetic switch. Because of the limited torque for the flexible meshing of this type of starter, in some cases, the driving gear cannot mesh with the flywheel gear ring and accordingly is pushed against the gear. As a consequence, the driving gear cannot mesh with the flywheel gear ring, thus the attracting coil is forced to be energized for a long time while a relatively large current flows through the coil, so the electromagnetic switch is prone to failure.

(2) Because a relatively large current flows through the attracting coil which has quite a few turns, a large electromagnetic force is generated by the electromagnetic switch and accordingly the driving gear applies a too large acting force to the end face of the flywheel gear ring, thereby badly damaging the end face of the flywheel gear ring; furthermore, since the driving gear applies a too large acting force to the end face of the flywheel gear ring, the driving gear of the starter is liable to be pushed against the gear, and if so, the transmission of the driving gear will be impeded by a high drag torque, and the fault that the electromagnetic switch is burnt out will easily occur as the driving gear is pushed against the gear for a long time.

(3) In order to ensure that a sufficiently large current flows through the attracting coil, the attracting coil has not many turns, thus the holding coil has not many turns, too, the coil has a higher current density, and the starter works for a long time, keeping elevating the temperatures of the coils too rapidly. Due to heat conduction, the attracting coil has a too high temperature, the starter has a too small braking torque for flexible meshing when it starts up again, then the faults of pushing against the gear and of burning out the electromagnetic switch would easily occur in the starter. If a method comprising increasing the coil diameter of the holding coil and rewinding it is employed for reducing the current density of the holding coil, such coil assembly is poor in winding process and the cost of the holding coil is high.

(4) In some abnormal conditions, e.g., when the flywheel gear ring and the driving gear do not match properly, the main contact point of the electromagnetic switch cannot be closed, then the attracting coil is compelled to have a large current flowing through it for a long time, so the fault of burning out would occur to the electromagnetic switch easily.

DISCLOSURE OF THE INVENTION

The technical problem to be solved by the present invention is to provide an auxiliary mesh type starter to solve the above-mentioned problems of the existing auxiliary mesh type starters.

To this end, the auxiliary mesh type starter according to the present invention comprises a motor, an electromagnetic switch connected to the motor and relays connected to the electromagnetic switch, wherein the electromagnetic switch comprises a holding coil, an attracting coil, a stop seat arranged at the rear end parts of the holding coil and the attracting coil, a plunger arranged on the inner circumferences of the holding coil and the attracting coil and capable of sliding in an axial direction, a return spring for applying a return force to the plunger, and a contact point arranged at the rear end of the plunger and the relays are connected to a key switch, wherein the relays comprise a first relay and a second relay, with the head end of the attracting coil being connected to the key switch via the first relay, and the head end of the holding coil being connected to the key switch via the second relay.

In said auxiliary mesh type starter, the number of turns of the attracting coil is less than the number of turns of the holding coil.

In said auxiliary mesh type starter, the number of turns of the attracting coil is zero.

In said auxiliary mesh type starter, the attracting coil is a means for limiting the magnitude of current.

In said auxiliary mesh type starter, the first relay is a time relay.

In said auxiliary mesh type starter, the second relay is a time relay.

In said auxiliary mesh type starter, the attracting coil is an aluminum enamelled wire, copper clad aluminum enamelled wire, constantan enamelled wire or iron wire.

The beneficial effects of the present invention are as follows:

(1) The head end of the attracting coil and the head end of the holding coil in the electromagnetic switch are connected separately and are controlled separately by different relays. In this way, the number of turns of the attracting coil needs not be the same as that of the holding coil, the number of turns of the holding coil may differ greatly from the number of turns of the attracting coil, and the attracting coil can be freely adjusted according to the required torque for meshing. Thus, the starter can generate a sufficiently large slow-turning torque, avoid the fault that the driving gear cannot rotate to mesh with the flywheel gear ring when the driving gear contacts the end face of the flywheel gear ring, avoid the faults of pushing against the gear, effectively decrease the possibility of burning out the electromagnetic switch, and prolong the service life of the starter.

(2) The holding coil may have quite a few turns and needs not be rewound. Thus it is ensured that the holding coil has a relatively low current density, the temperature rising rate of the holding coil will be significantly reduced, and the thermal damage to the holding coil will not occur. Besides, the following problem would not occur: the longtime work of the starter results in a high temperature of the holding coil, and due to heat conduction, the starter generates a small slow-turning torque in the case of another meshing. Moreover, the problem that the temperature of the holding coil rises too rapidly during the dragging of the starter can be effectively prevented, thereby effectively preventing the problem of a too high temperature of the attracting coil when the starter starts up again, i.e., preventing the problem that, due to the high temperature of the attracting coil, the current flowing through the holding coil is small, the slow-turning torque for meshing is too small, and the fault of pushing against the gear or meshing too long would occur in the starter.

(3) When power is off, the attracting coil and the holding coil of the electromagnetic switch would not form a series circuit, the two coils are in the off state, and thus the main contact point of the electromagnetic switch can be smoothly disconnected.

(4) When the relay that controls the attracting coil is a time relay, after the attracting coil is powered on for a short time (e.g., within 2 s), it is forced to be powered off, that is, the attracting coil stops working, so that in abnormal conditions (e.g., when the flywheel gear ring and the driving gear do not match properly and the latter cannot mesh with the former), the attracting coil would not have a large current flowing through it for a long time, thereby avoiding the fault of burning out the electromagnetic switch that is caused for particular and abnormal conditions. Similarly, a time relay (e.g., which is automatically disconnected after 30 s) can also be chosen as the relay that controls the holding coil, thereby avoiding the longtime power on of the holding coil that is caused for particular and abnormal conditions, and thereby preventing the armature, electromagnetic switch, isolator or the like from breaking down.

(5) The attracting coil may be made of a material having a higher resistivity, such as an aluminum enamelled wire, copper clad aluminum enamelled wire, constantan enamelled wire, iron wire, etc., thereby not only reducing the acting force that the driving gear of the starter applies to the end face of the flywheel gear ring but also reducing the cost of the electromagnetic switch.

(6) After the acting force that the driving gear applies to the end face of the flywheel gear ring is reduced, the extent of damage to the end face of the flywheel gear ring can be significantly reduced, thereby significantly prolonging the service time of the flywheel gear ring and fully satisfying the requirement for a starter with an idle start-stop system. In addition, as a small acting force is transmitted, the service lives of other parts (e.g., the shift fork, the driving gear, the isolator, and the electromagnetic switch, etc.) of the meshing system in the starter can be improved accordingly.

Hereinafter, the present invention is described in detail with reference to the accompanying drawings and embodiments, which, however, are not to limit the present invention.

Figure 1:
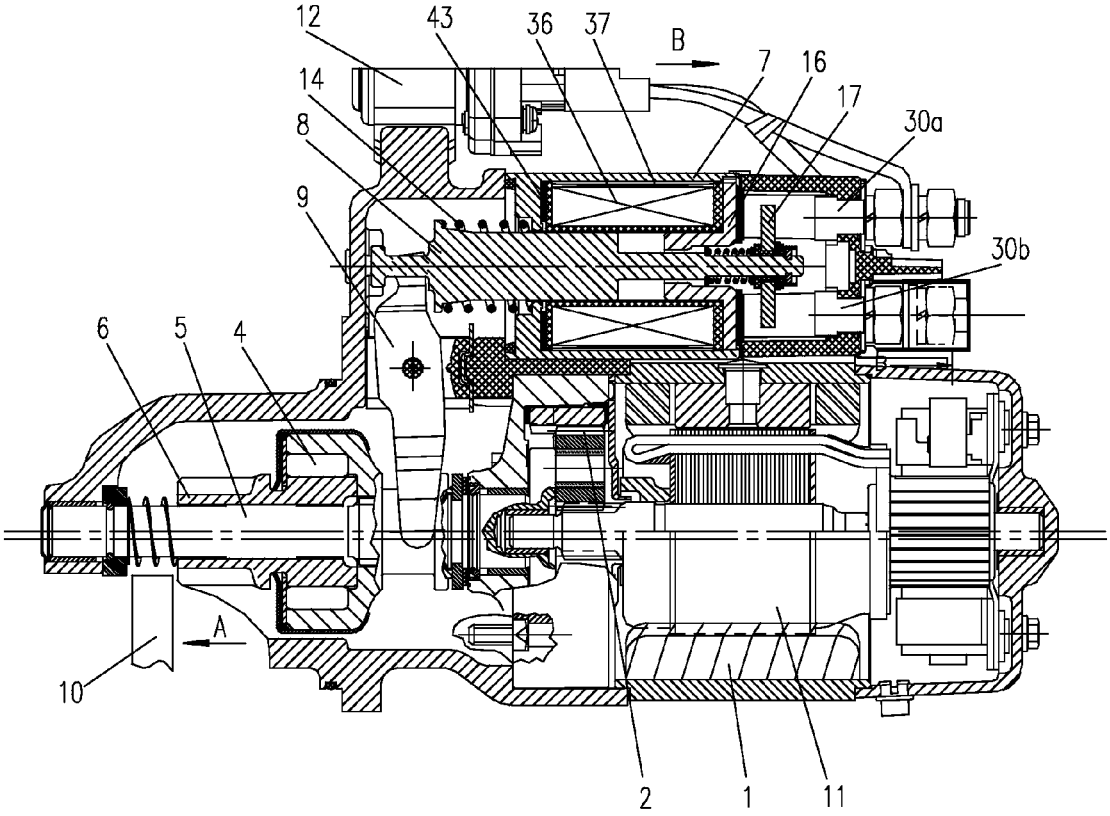
FIG. 1 (Prior Art)
FIG. 1 is a sectional view of an auxiliary mesh type starter in the prior art.
Figure 2:
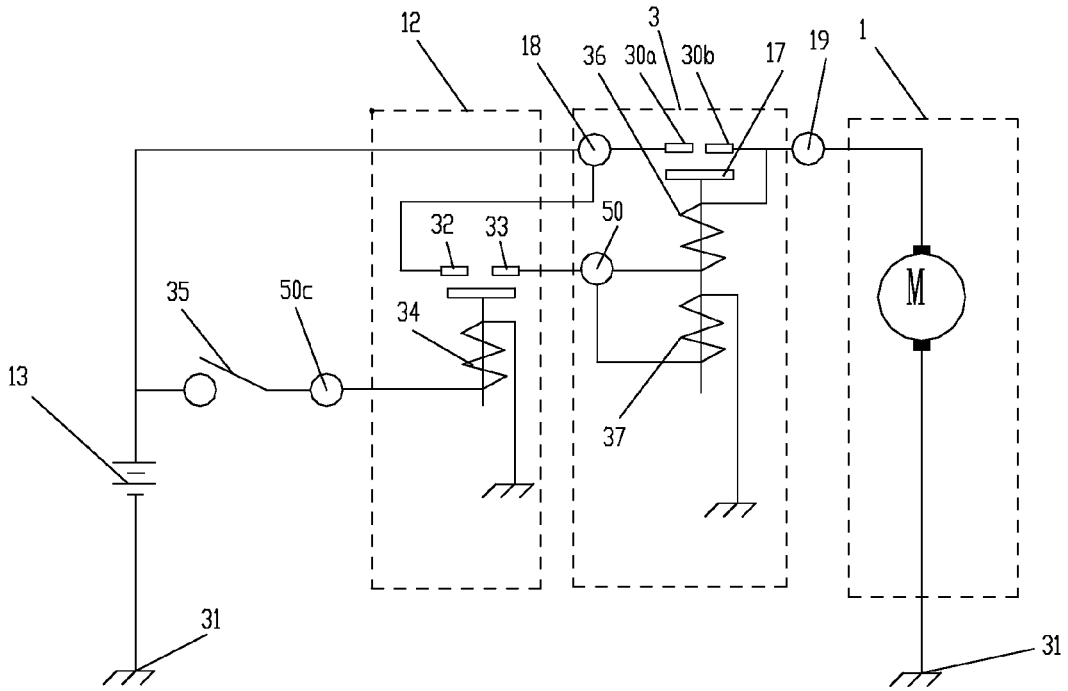
FIG. 2 (Prior Art)
FIG. 2 is an electrical wiring diagram of a starting circuit of the auxiliary mesh type starter shown in FIG. 1.

The following are the drawing reference signs:

1—motor
2—speed reducer
3—electromagnetic switch
4—isolator
5—output shaft
6—driving gear
7—solenoid body
8—plunger
9—shift fork
10—flywheel gear ring
11—armature
12—relay
13—storage battery
14—return spring
16—arresting disc
17—movable contact point
18, 19—terminal
30*a*, 30*b*—stationary contact point
31—negative terminal
32, 33—contact point
321, 322—contact point
331, 332—contact point
34—coil
341,342—coil
35—key switch
36—attracting coil
36'—current limiting resistor
37—holding coil
43—coil frame
50, 50 *i*, 50 *ii*—terminal
50*c*, 50*c i*, 50*c ii*—terminal

DETAILED DESCRIPTION OF THE INVENTION

Hereinafter, the technical solution of the present invention is described in detail with reference to the accompanying drawings and embodiments, so as to further make clear the object, solution and effect of the present invention, rather than limit the protection scopes of the appended claims of the present invention.

The auxiliary mesh type starters according to the present invention differs distinctly from the auxiliary mesh type starters in the prior art in that the head ends of an attracting coil and of a holding coil in an electromagnetic switch are connected separately and are controlled separately by different relays. Next, the aforesaid difference will be introduced in detail with reference to embodiments.

EXAMPLE 1

Figure 3:
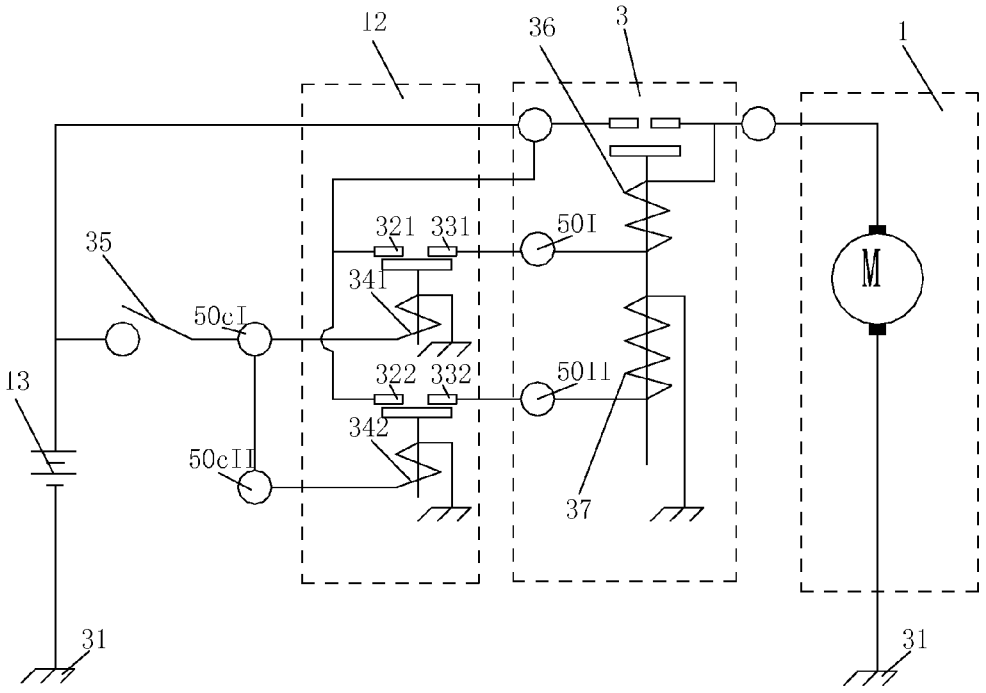
FIG. 3 is an electrical wiring diagram of a starting circuit of the auxiliary mesh type starter of Example 1 in the present invention.

Referring to FIG. 3, the auxiliary mesh type starter according to the present invention, which is substantially similar in structure to the auxiliary mesh type starter as shown in FIG. 1, also comprises a motor 1, an electromagnetic switch 3 connected to the motor 1 and relays 12 connected to the electromagnetic switch 3, wherein the relays 12 are connected to a key switch 35. The electromagnetic switch 3 is essentially the same as a common auxiliary mesh type electromagnetic switch, i.e., the electromagnetic switch 3 still controls the power on/off of the motor 1 using a pair of contact points, except that the head end of the attracting coil 36 and the head end of the holding coil 37 are connected separately and are controlled separately by two relays. To be specific, the relays 12 include a first relay and a second relay, wherein the first relay includes contact points 321, 331 and a coil 341, with the head end (which is connected to the terminal 50 I) of the attracting coil 36 being connected to the key switch 35 via the first relay, and wherein the second relay includes contact points 322, 332 and a coil 342, with the head end (which is connected to the terminal 50 II) of the holding coil 37 being connected to the key switch 35 via the second relay.

Other detailed structures of the auxiliary mesh type starter are the same as those in the prior art (for example, see FIG. 1). Details are not repeated herein.

In this example, since the attracting coil 36 and the holding coil 37 of the electromagnetic switch 3 are connected via two pairs of the contact points of relays (i.e., the head end of the attracting coil 36 and the head end of the holding coil 37 are not directly connected), the number of turns of the attracting coil 36 may differ greatly from the number of turns of the holding coil 37, that is, the numbers of turns need not be identical. Preferably, the number of turns of the attracting coil 36 can be far less than the number of turns of the holding coil 37, so that the attracting coil 36 has low resistance, which ensures that after the contact points of the relays 12 close and before the movable contact point 17 and the stationary contact points 30*a*, 30*b* of the electromagnetic switch 3 are connected, the current in the attracting coil 36 can enable the motor 1 to turn slowly.

In this example, the attracting coil 36 may be made of a material having a higher resistivity, such as an aluminum enamelled wire, copper clad aluminum enamelled wire, constantan enamelled wire, iron wire, etc. The coil diameter and the number of turns of the coil are adjusted according to the required slow-turning torque, thereby not only reducing the acting force that the driving gear 6 of the starter applies to the end face of the flywheel gear ring 10 but also reducing the cost of the electromagnetic switch 3.

Referring to FIG. 3 and FIG. 1, the auxiliary mesh type starter of the above-mentioned structure operates as follows: when the starter starts to work, the key switch 35 is turned on, the coil 341 in the first relay and the coil 342 in the second relay are excited respectively, and the movable and stationary contact points of the two relays are closed respectively. The terminals 501 and 5011 of the electromagnetic switch 3 are energized respectively, the attracting coil 36 and the holding coil 37 are powered on simultaneously, the electromagnetic force generated by the two coils causes the plunger 8 to move towards the arresting disc 16, and the motor 1 starts to rotate slowly to drive the driving gear 6 rotate. In the meanwhile, with the aid of the shift fork 9, the plunger 8 enables the driving gear 6 to move towards the flywheel gear ring 10, and the driving gear 6 flexibly meshes with the flywheel gear ring 10 while turning slowly. After that, the movable contact point 17 comes into contact with the main contact point of the electromagnetic switch 3 under the action of the plunger 8, the attracting coil 36 is short-circuited, a large electrical current flows through the motor 1, and then the motor 1 starts to output a full torque to start the engine. After the completion of starting, the key switch 35 is disconnected, the coils in the two relays are powered off simultaneously, the movable and stationary contact points of the two relays are disconnected respectively under the action of the return spring 14, the storage battery 13 is disconnected, no current flows through the attracting coil 36 and the holding coil 37, the electromagnetic force generated by the electromagnetic switch 3 disappears, the movable and stationary contact points of the electromagnetic switch 3 are disconnected under the action of the return spring 14, the motor 1 is powered off, the starter stops working, and the driving gear 6 returns to the initial state.

EXAMPLE 2

Figure 4:
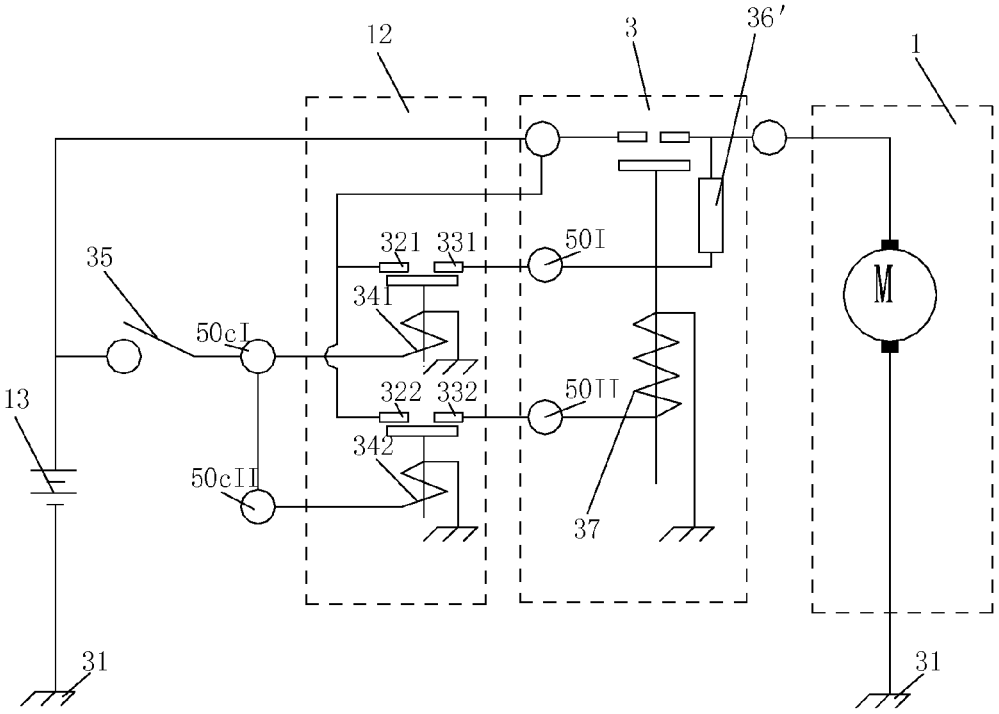
FIG. 4 is an electrical wiring diagram of a starting circuit of the auxiliary mesh type starter of Example 2 in the present invention.

Referring to FIG. 4, the structure in this example is substantially the same as the structure in Example 1. The difference is: in this embodiment, the number of turns of the attracting coil is zero; preferably, the attracting coil 36 is a means for limiting the magnitude of current, i.e., the attracting coil 36 can be regarded as a current limiting resistor 36', and the slow-turning torque of the starter is adjusted by adjusting the current limiting resistor 36'. That is to say, in this example, the electromagnetic switch 3 only has one coil (the holding coil 37), the electromagnetic force generated by the coil plays a role in holding the plunger 8 and also in attracting the plunger 8. Since the other structures are essentially the same as those described in Example 1, details are not repeated herein.

This example has the following advantages:

(1) Since the slow-turning torque of the starter is adjusted through the current limiting resistor, the magnitude of current limiting resistance can be arbitrarily designed based on the demand of the starter for a slow-turning torque and would not be subject to other factors. Therefore, the slow-turning torque can be increased, thus the slow-turning of the starter would not disappear with an increase in rotational resistance, and it is ensured that the starter can successfully achieve flexible meshing in any case.

(2) The number of turns of the holding coil can be set to a larger number, so that the thermal power generated by the electromagnetic switch is small and the fault of burning out the electromagnetic switch is unlikely to occur.

(3) The holding coil and the current limiting resistor are controlled by two relays, respectively. The electromagnetic switch is still of a common single-contact structure. In this way, under the circumstance that a relatively high reliability and reliable meshing of the starter are guaranteed, the structures and manufacturing processes of the starter and of the electromagnetic switch are not changed a lot on the whole.

EXAMPLE 3

Figure 5:
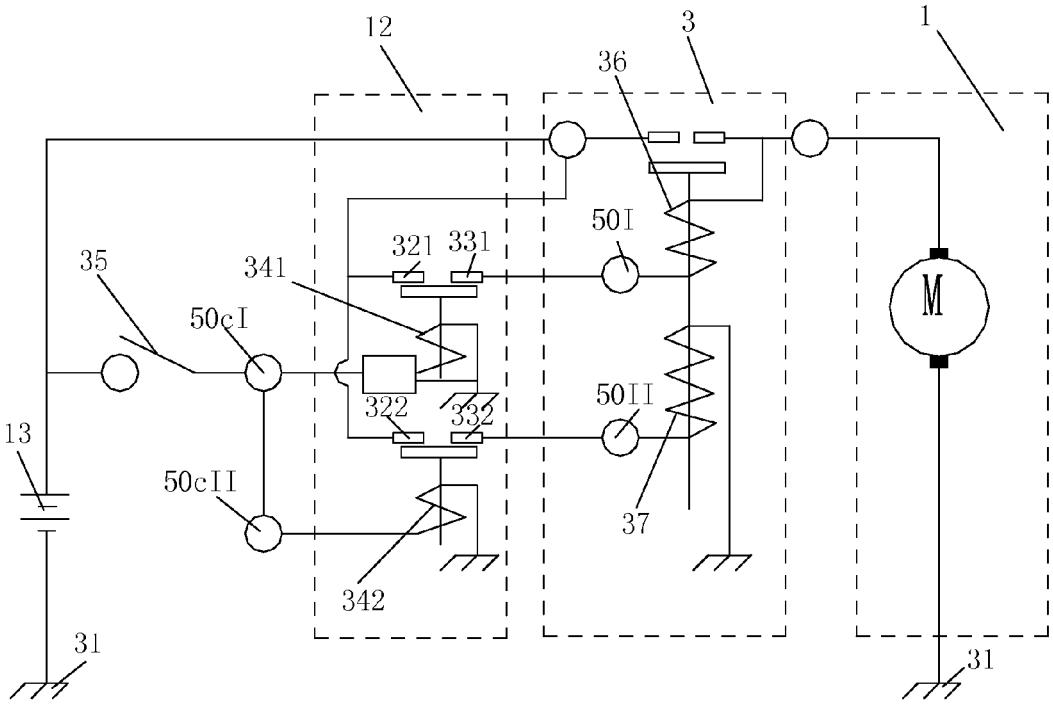
FIG. 5 is an electrical wiring diagram of a starting circuit of the auxiliary mesh type starter of Example 3 in the present invention.

Referring to FIG. 5, the structure in this example is substantially the same as the structure in Example 1, i.e., two relays are used to control the attracting coil 36 and the holding coil 37, respectively. The difference is: in this embodiment, the first relay that controls the attracting coil 36 is a time relay, i.e., the attracting coil 36 is controlled by a delay relay, so, after the attracting coil 36 is powered on for a short time (e.g., within 2 s), the contact points of the first relay are compelled to be disconnected so that in abnormal conditions (e.g., when the flywheel gear ring 10 and the driving gear 6 do not reasonably match and the latter cannot mesh with the former), the attracting coil 36 would not have a large current flowing through it for a long time, thereby avoiding the fault of burning out the electromagnetic switch that is caused for particular and abnormal conditions.

Similarly, the second relay that controls the holding coil 37 can also be a time relay. Thus, when a time relay (e.g., which is automatically disconnected after 30 s) is chosen as the second relay to control the holding coil 37, the fault that the electromagnetic switch 3 is burnt out due to the longtime power-on of the holding coil 37 can be avoided.

Since the other structures in this example are essentially the same as those described in Example 1, details are not repeated herein.

In this example, since the attracting coil 36 and the holding coil 37 of the electromagnetic switch 3 are connected via the contact points of two pairs of relays (i.e., the head end of the attracting coil 36 and the head end of the holding coil 37 are not directly connected), the number of turns of the attracting coil 36 may differ greatly from the number of turns of the holding coil 37, that is, the numbers of turns need not coincide. Preferably, the number of turns of the attracting coil 36 can be far less than the number of turns of the holding coil 37, so that the attracting coil 36 has low resistance, which ensures that after the closure of the contact points of the relays 12 and before the movable contact point and the stationary contact points of the electromagnetic switch 3 are turned on, the current in the attracting coil 36 can enable the motor 1 to turn slowly.

In this example, the attracting coil 36 may also be made of a material having a higher resistivity, such as an aluminum enamelled wire, copper clad aluminum enamelled wire, constantan enamelled wire, iron wire, etc. The coil diameter and the number of turns of the coil are adjusted according to the required slow-turning torque, thereby not only reducing the acting force that the driving gear 6 of the starter applies to the end face of the flywheel gear ring 10 but also reducing the cost of the electromagnetic switch.

Referring to FIG. 5 in combination with FIG. 1, the working process of the auxiliary mesh type starter having the above-mentioned structure is described as follows: when the starter starts to work, the key switch 35 is turned on, the coil 341 in the first relay (a time relay) and the coil 342 in the second relay are excited separately, and the movable and stationary contact points of the two relays are closed separately. The terminals 50 I and 50 II of the electromagnetic switch 3 are energized separately, the attracting coil 36 and the holding coil 37 are powered on simultaneously, the electromagnetic force generated by the two coils causes the plunger 8 to move towards the arresting disc 16, and, with the aid of the shift fork 9, the plunger 8 enables the driving gear 6 to move towards the flywheel gear ring 10; in the meanwhile, the motor 1 starts to rotate slowly and the driving gear 6 rotates accordingly, the driving gear 6 flexibly meshes with the flywheel gear ring 10 while turning slowly; then, the movable contact point 17 comes into contact with the main contact point of the electromagnetic switch 3 under the action of the plunger 8, the attracting coil 36 is short-circuited, a large electrical current flows through the motor 1, and then the motor 1 starts to output a full torque to start the engine; during the starting, the time relay is powered off in advance according to the designed power-off time. After the completion of starting, the key switch 35 is disconnected, the coil in the second relay is powered off, the movable and stationary contact points of said relay are disconnected under the action of the return spring 14, the storage battery 13 is disconnected, no current flows through the attracting coil 36 and the holding coil 37, the electromagnetic force generated by the electromagnetic switch 3 disappears, the movable and stationary contact points of the electromagnetic switch 3 are disconnected under the action of the return spring 14, the motor 1 is powered off, the starter stops working, and the driving gear 6 returns to the initial state. The working process in this example is substantially the same as that described in Example 1, and they only differ when the main contact point of the electromagnetic switch 3 cannot be closed and the attracting coil 36 is forced to be powered on for a long time.

In abnormal conditions, e.g., when the flywheel gear ring 10 and the driving gear 6 do not match properly, when the starter is energized, the main contact point of the electromagnetic switch 3 cannot be closed and the attracting coil 36 is forced to be powered on for a long time. However, a time relay has the function of delaying forced power-off, for example, the attracting coil 36 is energized for 2 s, then the time relay stops the process, the contact points are disconnected, the attracting coil 36 and the storage battery 13 are in an off state, and then no current flows through the attracting coil 36, thereby effectively avoiding the occurrence of a fault in the attracting coil 36 of the electromagnetic switch 3.

EXAMPLE 4

Figure 6:
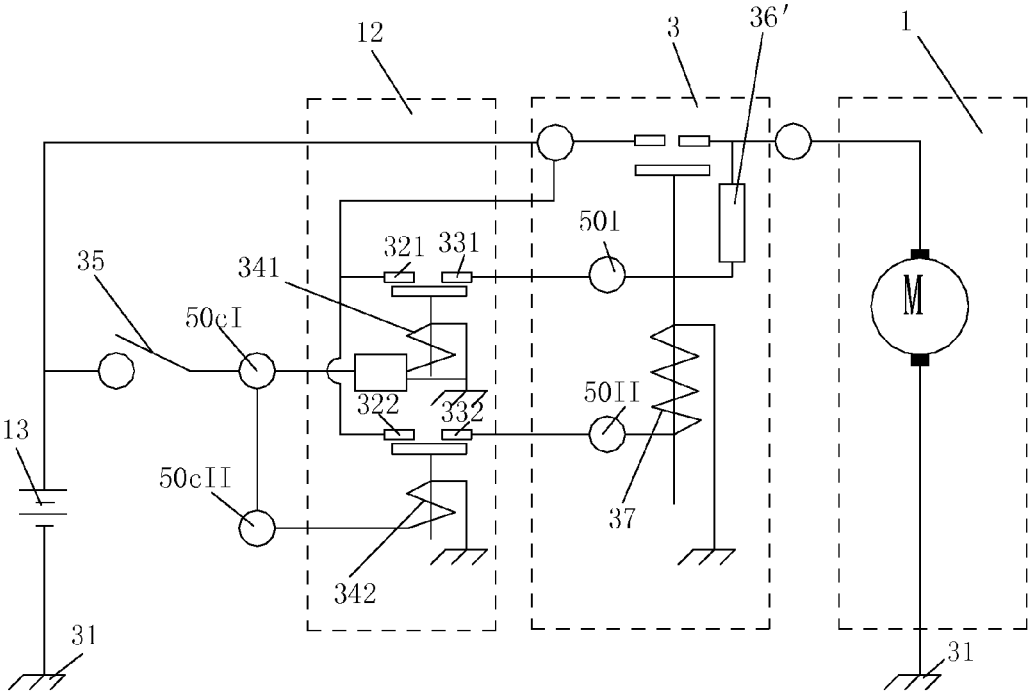
FIG. 6 is an electrical wiring diagram of a starting circuit of the auxiliary mesh type starter of Example 4 in the present invention.

Referring to FIG. 6, the structure in this example is substantially the same as the structure in Example 3, i.e., the attracting coil 36 and the holding coil 37 are still controlled by two relays, respectively, the first relay that controls the attracting coil 36 is a time relay, and the holding coil can also be controlled by a time relay. The difference is: in this embodiment, the number of turns of the attracting coil 36 is zero; preferably, the attracting coil 36 is a means for limiting the magnitude of current, i.e., the attracting coil 36 can be regarded as a current limiting resistor 36', and the slow-turning torque of the starter is adjusted by adjusting the current limiting resistor 36'. That is to say, in this example, the electromagnetic switch 3 only has one coil (the holding coil 37), the electromagnetic force generated by the coil plays a role in holding the plunger 8 and also in attracting the plunger 8.

Since the other structures are essentially the same as those described in Example 3, details are not repeated herein.

This example has the following advantages:

(1) Since the slow-turning torque of the starter is adjusted through the current limiting resistor, the magnitude of current limiting resistance can be arbitrarily designed based on the demand of the starter for a slow-turning torque and would not be subject to other factors. Therefore, the slow-turning torque can be increased, thus the slow-turning of the starter would not disappear with an increase in rotational resistance, and it is ensured that the starter can successfully achieve flexible meshing in any case.

(2) A time relay is used to control the attracting coil of the electromagnetic switch, thereby effectively avoiding the fault that the electromagnetic switch is burnt out in some exceptional case, e.g., when the main contact point of the electromagnetic switch cannot be closed.

(3) The holding coil and the current limiting resistor are controlled by two relays, respectively. The electromagnetic switch is still of a common single-contact structure. In this way, under the circumstance that a relatively high reliability and reliable meshing of the starter are guaranteed, the structures and manufacturing processes of the starter and of the electromagnetic switch are not changed a lot on the whole.

(4) The number of turns of the holding coil can be set to a larger number, so that the thermal power generated by the electromagnetic switch is small and the fault of burning out the electromagnetic switch is unlikely to occur.

Of course, the present invention may have a variety of other embodiments. Those skilled in the art can make all kinds of corresponding changes and modifications according to the present invention without departing from the spirit and essence of the present invention. It is intended that all these changes and modifications be covered by the appended claims of the present invention.

The invention claimed is:

1. An auxiliary mesh type starter, comprising a motor, an electromagnetic switch connected with the motor and relays connected with the electromagnetic switch, wherein the electromagnetic switch comprises a holding coil, an attracting coil, a stop seat arranged at the rear end parts of the holding coil and the attracting coil, a plunger arranged on the inner circumferences of the holding coil and the attracting coil and capable of sliding in an axial direction, a return spring for applying a return force to the plunger, and a contact point arranged at the rear end of the plunger and the relays are connected to a key switch, characterized in that the relays comprise a first relay and a second relay, with the head end of the attracting coil being connected to the key switch via the first relay, and the head end of the holding coil being connected to the key switch via the second relay.

2. The auxiliary mesh type starter according to claim 1, wherein the number of turns of the attracting coil is less than the number of turns of the holding coil.

3. The auxiliary mesh type starter according to claim 2, wherein the first relay is a time relay.

4. The auxiliary mesh type starter according to claim 3, wherein the attracting coil is an aluminum enamelled wire, copper clad aluminum enamelled wire, constantan enamelled wire or iron wire.

5. The auxiliary mesh type starter according to claim 2, wherein the second relay is a time relay.

6. The auxiliary mesh type starter according to claim 5, wherein the attracting coil is an aluminum enamelled wire, copper clad aluminum enamelled wire, constantan enamelled wire or iron wire.

7. The auxiliary mesh type starter according to claim 2, wherein the attracting coil is an aluminum enamelled wire, copper clad aluminum enamelled wire, constantan enamelled wire or iron wire.

8. The auxiliary mesh type starter according to claim 2, wherein the number of turns of the attracting coil is zero.

9. The auxiliary mesh type starter according to claim 8, wherein the first relay is a time relay.

10. The auxiliary mesh type starter according to claim 9, wherein the attracting coil is an aluminum enamelled wire, copper clad aluminum enamelled wire, constantan enamelled wire or iron wire.

11. The auxiliary mesh type starter according to claim 8, wherein the second relay is a time relay.

12. The auxiliary mesh type starter according to claim 11, wherein the attracting coil is an aluminum enamelled wire, copper clad aluminum enamelled wire, constantan enamelled wire or iron wire.

13. The auxiliary mesh type starter according to claim 8, wherein the attracting coil is an aluminum enamelled wire, copper clad aluminum enamelled wire, constantan enamelled wire or iron wire.

14. The auxiliary mesh type starter according to claim 8, wherein the attracting coil is a means for limiting the magnitude of current.

15. The auxiliary mesh type starter according to claim 14, wherein the attracting coil is an aluminum enamelled wire, copper clad aluminum enamelled wire, constantan enamelled wire or iron wire.

16. The auxiliary mesh type starter according to claim 1, wherein the attracting coil is an aluminum enamelled wire, copper clad aluminum enamelled wire, constantan enamelled wire or iron wire.

* * * * *